United States Patent [19]

Adams et al.

[11] 4,335,282

[45] Jun. 15, 1982

[54] TIMER SWITCH MODULE

[75] Inventors: Richard E. Adams, Indianapolis; Richard W. Stafford, Clayton, both of Ind.

[73] Assignee: Emhart Industries, Inc., Indianapolis, Ind.

[21] Appl. No.: 133,532

[22] Filed: Mar. 24, 1980

[51] Int. Cl.[3] ..... H01H 7/00

[52] U.S. Cl. ..... 200/38 R; 200/38 A; 200/38 FA

[58] Field of Search ..... 200/38 R, 38 A, 38 F, 200/38 FA, 38 FB

[56] References Cited

U.S. PATENT DOCUMENTS 3,967,077 6/1976 Willis ..... 200/38 FA

*Primary Examiner*—R. L. Moses

*Assistant Examiner*—Morris Ginsburg

*Attorney, Agent, or Firm*—Robert F. Meyer; David W. Gomes

[57] ABSTRACT

A free-floating shorting bar carries electrical contacts at opposed ends thereof. The shorting bar is actuated to open and close mating electrical contacts by a pair of axially indexable shafts in a manner whereby three electrical contact conditions are provided: (1) With both shafts indexed "out" a first set of contacts is closed and a second set is opened; (2) With both shafts indexed "in" the first set is open and the second set closed; and (3) When one shaft is indexed "out" and one "in", both sets of contacts are closed.

9 Claims, 5 Drawing Figures

TIMER SWITCH MODULE

BACKGROUND OF THE INVENTION

Generally speaking, the present invention pertains to a timing mechanism wherein at least first and second sets of electrical contacts are opened and closed in response to axial indexing of corresponding first and second shafts, and wherein a coupling means between the sets of electrical contacts and the shafts provides alternative conditions of the sets of electrical contacts whereby three electrical contact conditions are provided, namely: (1) with both the first and second shafts indexed "out" the first set of electrical contacts is closed and the second set open, (2) with both the shafts indexed "in" the first set of electrical contacts is open and the second set is closed, and (3) with the first shaft indexed "out" and the second shaft indexed "in" both the first and second sets of electrical contacts are closed.

The present invention is adaptable to range timers and particularly to range timers wherein the timers need to provide cooking time duration starting at a preselected time and ending at a preselected time.

While such timers are relatively well known in the art, the timers are for the most part complicated, bulky, and costly to produce. Moreover, because of their mode of structure, interchangeability between range timer dial plates is difficult if not impossible to achieve. The present range timer provides a modular structure which is simple and thus overcomes these problems.

OBJECTS OR FEATURES OF THE INVENTION

It is therefore a feature of the present invention to provide a range timer which has a modular form and yet simple in structure. Another feature of the invention is to provide a timer wherein a set of electrical contacts are selectively actuated by a pair of individual axial movable shafts. Another feature of the invention is the provision of such a timer wherein a coupling means couples the sets of electrical contacts to the shafts in such a manner to provide three electrical contact conditions of the sets of electrical contacts. Yet another feature of the invention is the provision of such a timer wherein the coupling means includes a movable shorting bar carrying an electrical contact at opposed ends thereof and a pair of actuator means individually engaging the shorting bar and individually coupled to the shafts. Still another feature of the invention is the provision of such a timer wherein the shorting bar is spring biased against the actuator means individually by a pair of springs that are individually biased in opposite directions so as to permit the opposed ends carrying the electrical contacts to be moved and independently open and close mating electrical contacts. Another feature of the invention is the provision of such a timer wherein there are two shorting bars to open and close four sets of electrical contacts, each of the shorting bars operating from the two axial movable shafts through the pair of actuator means. Another feature of the invention is the provision of such a timer wherein the shafts are axially indexed manually or through cams carried by the shafts. These and other features of the invention will be apparent from the following description taken in conjunction with the accompanying drawings.

DETAILED DESCRIPTION OF THE INVENTION

Figure 1:
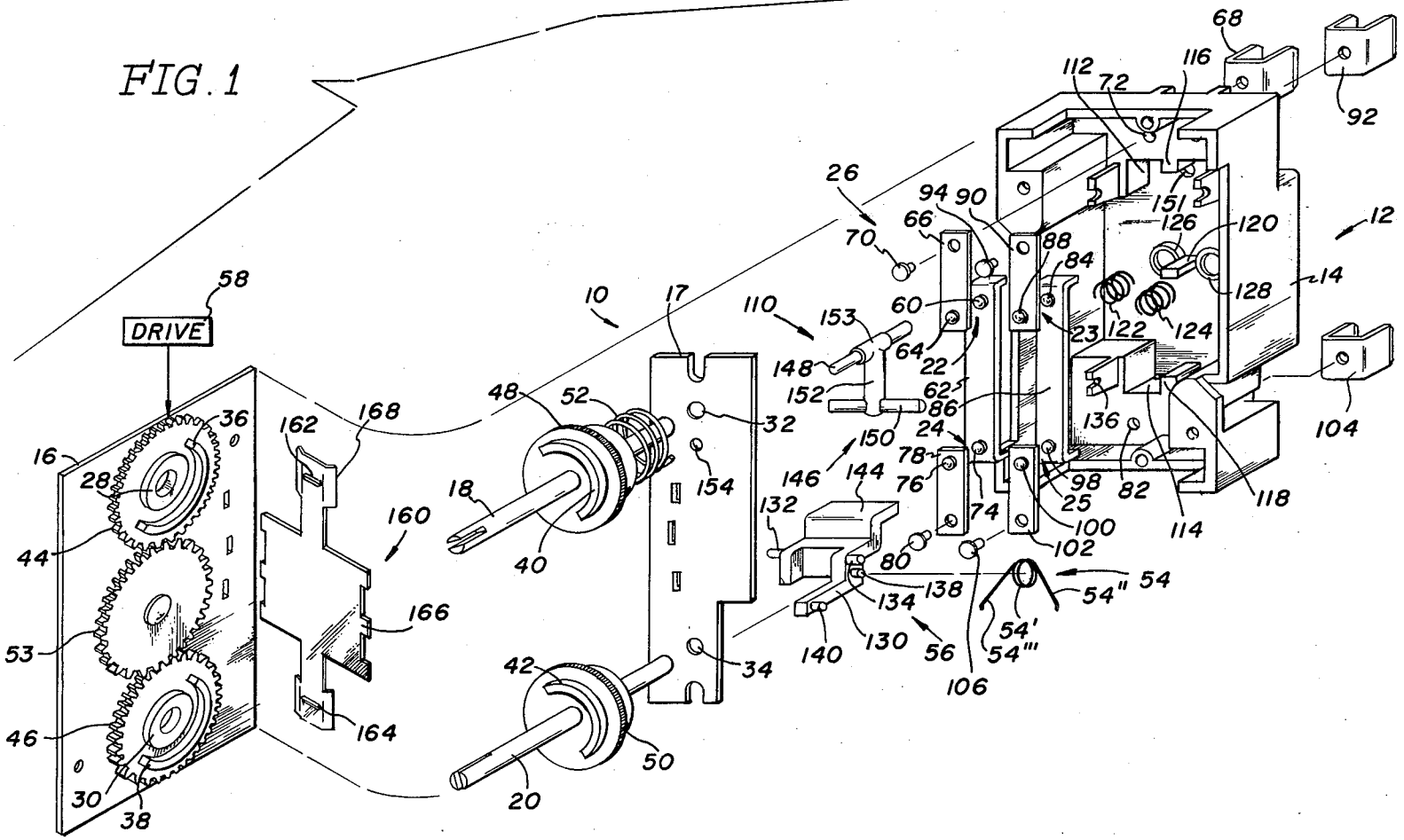
FIG. 1 is an exploded view of a timer employing the features of the invention.

Referring now to the drawings, and in particular to FIG. 1, there is shown a range timer or timing mechanism 10 employing the features of the invention. The timing mechanism itself is enclosed in a housing 12 which is composed of a plastic cup shaped member 14 with an open end that is closed by a metal plate 16. A plate 17 divides the housing into two sections. The timing mechanism includes a pair of axially indexable shafts 18 and 20, four sets of electrical contacts 22, 24 and 23, 25 and coupling means 26 which couples the electrical contacts to shafts 18 and 20 so as to be opened and closed in accordance with an axial indexing of the shafts.

Shafts 18 and 20 are rotatably journalled in place 16 through bushings 28 and 30 and in plate 17 through apertures 32 and 34. The shafts may be manually rotated and axially indexed either manually or through the cooperation of cooperating cams 36, 40 and 38, 42. Cams 36 and 38 are fixedly carried on gears 44 and 46, respectively, while cams 40 and 42 are fixedly carried on cam discs 48 and 50. Gears 44 and 46 are rotatably carried about bushings 28 and 30 on plate 16 while cam discs 48 and 50 are fixedly carried on shafts 18 and 20, respectively.

As will be further discussed, when cam discs 48 and 50 and the shafts are axially spring biased such that the shafts are "out" the cams 40 and 42 ride on the faces of gears 44 and 46 adjacent cams 36 and 38. Cam disc 48 and shaft 18 are spring biased through coil spring 52 which is carried about shaft 18 between plate 17 and cam disc 48. Cam disc 50 and shaft 20 is spring biased through a return torsion spring 54 carried by actuator means 56, the operation of which will be described with respect to the actuator means. Shafts 18 and 20 can be manually indexed "in" and manually rotated to set cams 40 and 42 to overlay cams 36 and 38 a predetermined amount. Power driven rotation is then applied to gear 44 through a drive means 58 and gear 46 through idler gear 53 which meshes with and is driven by gear 44. Rotation of gears 44 and 46 causes rotation of cams 36 and 38 until they no longer overlay cams 40 and 42 to thus permit cams 40 and 42 to return to their original positions on the faces of gears 44 and 46 adjacent cams 36 and 38 through the action of coil spring 52 and return spring 54.

Drive means 58 may be of any suitable type and in an oven or range application it may be an output from a digital clock.

The set of electrical contacts 22 are provided by an electrical contact 60 which is carried at an end of a shorting bar 62, and electrical contact 64 which is carried on a fixed contact blade 66 which is electrically connected to an electrical terminal 68 through a rivet 70 which extends through aperture 72 of housing 12. The set of electrical contacts 24 are provided by an electrical contact 74 carried at the other end of shorting bar 62 and electrical contact 76 carried by fixed contact blade 78 which is electrically connected to an electrical terminal (not shown) by a rivet 80 which extends through an aperture 82 provided in housing 12. In like manner the set of electrical contacts 23 is provided by an electrical contact 84 carried at an end of shorting bar 86 and an electrical contact 88 that is carried by fixed contact blade 90 that is electrically connected to an electrical terminal 92 through rivet 94 which extends through an aperture in housing 12 (not shown), while set 25 is provided by electrical contact 98 carried at the other end of shorting bar 86 and electrical contact 100 carried by fixed contact blade 102 that is electrically connected to electrical terminal 104 through rivet 106 extending through an aperture in housing 12 (not shown). As will be described hereinafter, an electrical circuit for the sets of contacts are completed through the shorting bars. Thus, for example, an electrical circuit will be completed through shorting bar 62 when sets 22 and 24 are closed. The use of two shorting bars and the accompanying sets of contacts is a preferable embodiment of the invention for use in range timers where 220 volt AC outlets are common and is necessary to switch both sides of the line. Other applications may require only one shorting bar and two sets of contacts. By the present invention, the extra sets of contacts may be used and made operable off the two shafts by the coupling means 26.

Coupling means 26 couples the sets of electrical contacts to shafts 18 and 20 so that the electrical contacts are opened and closed in response to an axial indexing of the shafts. Coupling means 26 includes shorting bars 62 and 86 and actuator means 56 and 110. The shorting bars, which carry the electrical contacts previously described are individually free floating and confined in individual compartments 112 and 114 defined by the outer walls of housing 12 and opposed spacers 116 and 118. They are further separated by a spacer 120 extending from housing 12. The shorting bars are spring biased near their center portion by coil springs 122 and 124 which engage the surface of their respective shorting bars and housing 12 within collars 126 and 128 extending from the housing.

Figure 2:
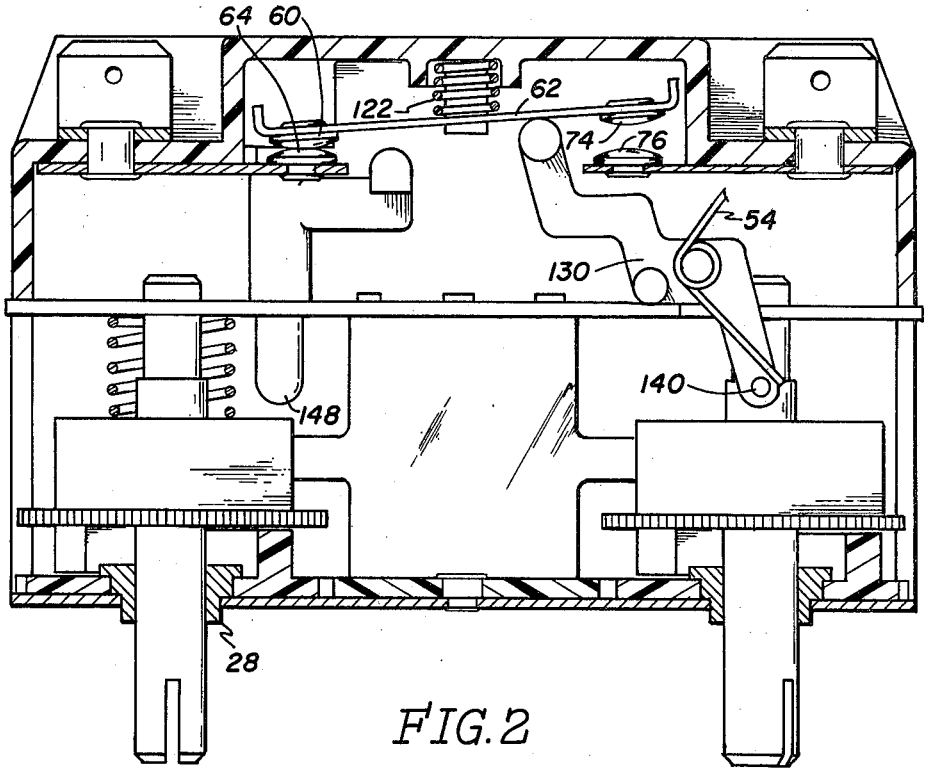
FIGS. 2 through 4 are partial sections showing three different operating modes of the timer.
Figure 3:
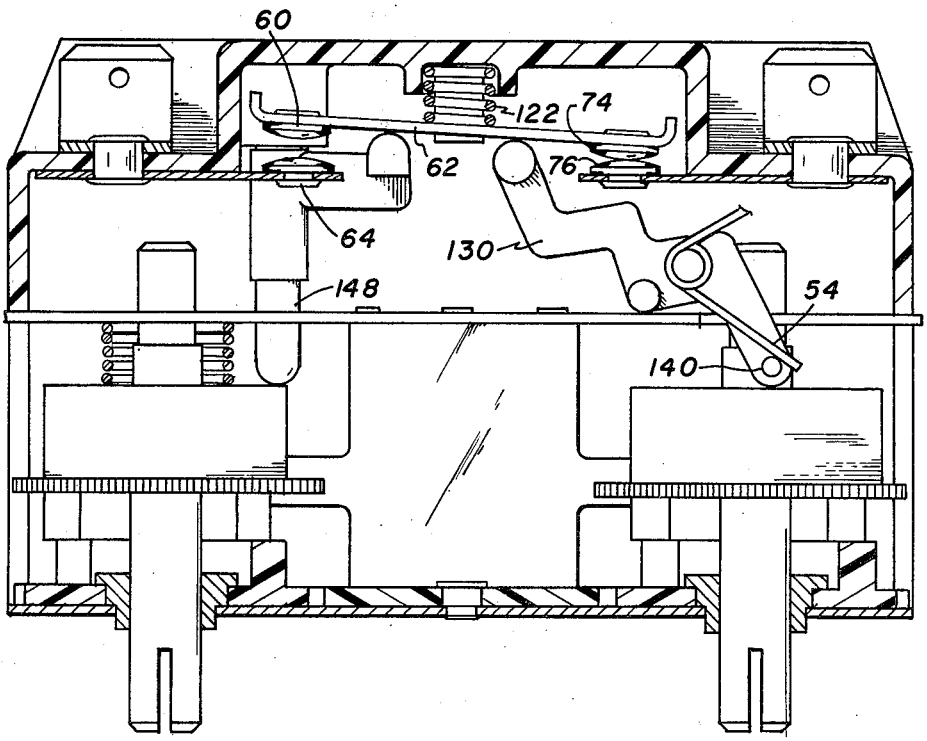
Figure 4:
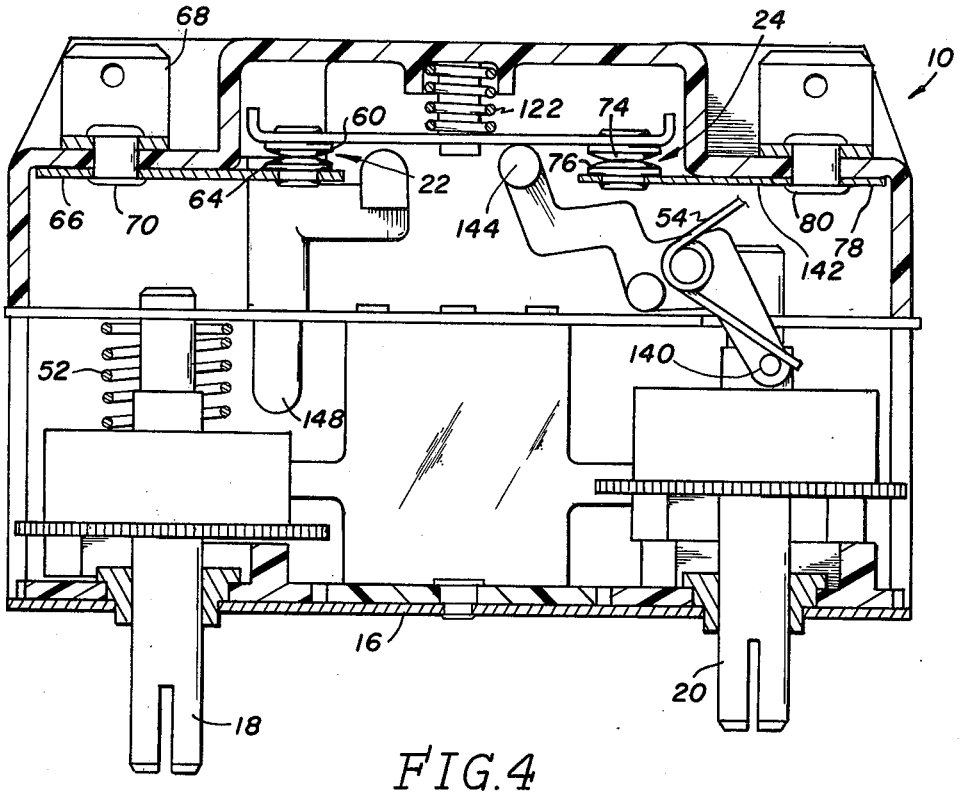
Figure 5:
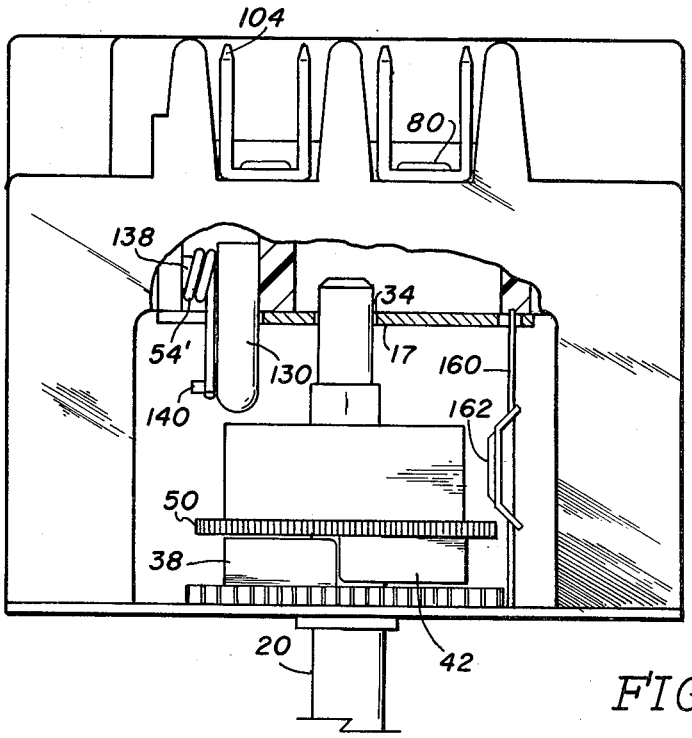
FIG. 5 is an end view of the timer with a portion thereof removed.

Actuator means 56 includes lever 130 which is pivotaly mounted within housing 12 through pins 132 and 134 which are carried in oppositely disposed slots 136. The lever, and thus shaft 20, is spring biased through torsion spring 54 having a coil 54' carried on post 138 and arms 54'' and 54''' engaging post 140 and a wall 142 (FIG. 4) of housing 12, respectively. The end 144 of the lever engages both shorting bars 62 and 86 near their central portions between the ends of the bars and the area engaged by coil springs 122 and 124. Post 140 connects the lever to shaft 20 (FIGS. 2–4). Axial indexing of shaft 20 causes movement of the end of the shorting bar on the side it engages.

Actuator means 110 includes a plunger means 146 which comprises a plunger 148 that is connected to a cross bar 150 by a connecting bar 152. Plunger 148 extends through aperture 151 of cup shaped member 14 and aperture 154 of plate 17 to engage cam member 48 to be axially indexed in accordance with an axial movement of the cam member. Its movement is limited by a collar 153, the ends of which engage plate 17 and cup shaped member 14. Cross bar 150 engages both shorting bars 62 and 86 near their central portions between the ends of the bars and coil springs 122 and 124.

Coil spring 52 and torsion spring 54 in conjunction with lever 130 provide a bias against shorting bars 62 and 86 with respect to actuator means 56 and 110 so that the opposed ends of the bars can be moved in opposite directions to independently open and close electrical contacts.

A detent means 160 prevents rotation of cam members 48 and 50 when they are indexed "in" when the shafts are indexed "in". Detent means 160 includes a pair of springs 162 and 164 projecting from a web portion 166, the web portion being secured to plates 16 and 17. Springs 162 and 164 each have bent flange portions 168 for ease in receiving the cam members.

The actuation of the electrical contacts can be described with reference to shorting bar 62 and its contacts, it being understood that the operation would also apply to shorting bar 86 and its contacts. Because of the central location of coil spring 122 or 124 with respect to a shorting bar and because spring 52 and spring 54 in conjunction with lever 130 causes the ends of the bar to be biased in opposite directions, the mode of one set of electrical contacts with respect to a shorting bar will be the opposite to the other even though both shafts are indexed to the same position. And if the individual shafts are indexed opposite to one another, the modes of both sets of electrical contacts will be the same. In FIG. 2, both shafts 18 and 20 have been indexed "out". Lever 130 has been pivoted against the normal bias of torsion spring 54 to move shorting bar 62 against the bias of spring 122 so as to open contacts 74 and 76. Spring 52 remains in its normally expanded position and contacts 60 and 64 remain closed. In FIG. 3, both shafts 18 and 20 have been indexed "in". Spring 54 returns to its normally biased condition and contacts 74 and 76 are closed. Coil spring 52 has been compressed and plunger 148 has been moved up to move shorting bar 62 up against the bias of spring 122 to open contacts 60 and 64. In FIG. 4, shaft 18 has been indexed "out" and shaft 20 remains indexed "in". Spring 52 returns to its normal bias position and plunger 148 also returns to permit contacts 60 and 64 to also be closed.

The operation of the device (again with reference to shorting bar 62 only) can now be described with reference to both manual and cam indexing of the shafts as might be used in a range timer. In such applications drive 58 would be the output from a digital clock, for example.

Starting with both shafts 18 and 20 being indexed "out" (FIG. 2), shaft 18 is manually indexed "in" and rotated so as to override cam 40 onto cam 36, the amount of override being dependent upon a desired cooking time start, say for example 3:00 P.M. Shaft 20 is likewise manually indexed "in" and rotated to override cam 42 on cam 38, the amount of override being dependent upon the length of cooking time, say 2 hours for example. As noted previously with respect to FIG. 3, electrical contacts 60 and 64 would be open and electrical contacts 74 and 76 would be closed. Upon power driven rotation, drive means 58 will drive both cams 36 and 38 through cooperating gears 44, 53 and 46. Springs 162 and 164 will hold cams 40 and 42 in place. When cam 36 reaches the 3:00 P.M. set point, cam 40 drops to index shaft 18 "out" and close electrical contacts 60 and 64 (FIG. 4). An electrical circuit is now completed through contacts 60 and 64, shorting bar 62 and contacts 74 and 76. Cooking time begins. When the cooking time is completed, cam 42 drops off cam 38, shaft 20 is indexed "out" and (FIG. 2) electrical contacts 74 and 76 will be open and contacts 60 and 64 will be closed. The cycle has been completed and the timer is set for the next cycle.

What is claimed is:

1. In a timing mechanism comprising at least first and second sets of electrical contacts opened and closed in response to axial indexing of corresponding first and second shafts; and a coupling means between said sets of electrical contacts and said shafts providing alternative conditions of said sets of electrical contacts whereby three electrical contact conditions are provided:

(1) with both said first and second shafts indexed out, said first set of electrical contacts is closed and said second set of electrical contacts is open;

(2) with both said shafts indexed in, said first set of electrical contacts is open and said second set of electrical contacts is closed;

(3) with said first shaft indexed out and said second shaft indexed in, both said first and second sets of electrical contacts are closed.

2. In a timing mechanism according to claim 1, wherein said coupling means includes a shorting bar carrying electrical contacts at opposed ends thereof, first and second actuator means individually engaging said shorting bar and individually coupled to said first and second shafts, and first and second spring biasing means individually biasing said first and second actuator means in opposite directions against said shorting bar.

3. In a timing mechanism according to claim 2 wherein said shorting bar is carried within a compartment, a wall of which limits movement of said shorting bar normal to movement of said first and second actuator means.

4. In a timing mechanism according to claim 3 wherein said shorting bar is spring biased through a coil spring disposed between said shorting bar near its center and a wall of said compartment.

5. In a timing mechanism according to claim 4 wherein said shorting bar is free floating.

6. In a timing mechanism according to claim 1 wherein there are third and fourth sets of electrical contacts and said coupling means additionally couples same to said first and second shafts.

7. In a timing mechanism according to claim 6 wherein said coupling means includes first and second shorting bars carrying electrical contacts at opposed ends of each of said shorting bars, first and second actuator means engaging said first and second shorting bars and coupled to said first and second shafts, and spring biasing means biasing said first and second shorting bars against said first and second actuator means.

8. In a timing mechanism according to claim 1 wherein said shafts are indexed manually and in response to cooperating cams carried by each of said shafts during power driven rotation of said shafts.

9. In a timing mechanism according to claim 8 further including spring means selectively engaged by said cams to selectively prevent rotation of said shafts.

* * * * *